US009441794B2

(12) United States Patent
Huang

(10) Patent No.: US 9,441,794 B2
(45) Date of Patent: Sep. 13, 2016

(54) LAMP TUBE

(71) Applicant: LEXTAR ELECTRONICS CORPORATION, Hsinchu (TW)

(72) Inventor: Jiun-Shi Huang, Kaohsiung (TW)

(73) Assignee: Lextar Electronics Corporation, Hsinchu (TW)

( * ) Notice: Subject to any disclaimer, the term of this patent is extended or adjusted under 35 U.S.C. 154(b) by 240 days.

(21) Appl. No.: 14/337,501

(22) Filed: Jul. 22, 2014

(65) Prior Publication Data

US 2015/0124439 A1 May 7, 2015

(30) Foreign Application Priority Data

Nov. 4, 2013 (TW) ..... 102139912 A

(51) Int. Cl.

| | |
|---|---|
| ***F21V 7/20*** | (2006.01) |
| ***F21K 99/00*** | (2016.01) |
| ***F21V 19/00*** | (2006.01) |
| ***F21V 29/74*** | (2015.01) |
| ***F21V 29/89*** | (2015.01) |
| *F21V 3/02* | (2006.01) |
| *F21V 3/04* | (2006.01) |
| *F21V 17/10* | (2006.01) |
| *F21Y 101/02* | (2006.01) |
| *F21Y 103/00* | (2016.01) |

(52) U.S. Cl.

CPC ..... *F21K 9/175* (2013.01); *F21V 19/0055* (2013.01); *F21V 29/74* (2015.01); *F21V 29/89* (2015.01); *F21V 3/02* (2013.01); *F21V 3/0436* (2013.01); *F21V 17/104* (2013.01); *F21Y 2101/02* (2013.01); *F21Y 2103/003* (2013.01)

(58) Field of Classification Search

CPC ..... F21K 9/1355; F21K 9/175; F21K 9/13; F21Y 2103/00

See application file for complete search history.

(56) References Cited

U.S. PATENT DOCUMENTS

| | | | | |
|---|---|---|---|---|
| 2012/0106144 | A1* | 5/2012 | Chang | F21K 9/17 362/218 |
| 2013/0050998 | A1* | 2/2013 | Chu | F21K 9/17 362/218 |
| 2013/0301255 | A1* | 11/2013 | Kim | F21K 9/17 362/218 |

* cited by examiner

*Primary Examiner* — Evan Dzierzynski

(57) ABSTRACT

A lamp tube is provided, including a cover, a heat sink, and a light bar. The cover includes a first connection portion and a second connection portion opposite to each other. The heat sink includes a base, a first supporting portion, and a second supporting portion extended upwardly from the base. The first and second supporting portions respectively include a first recess and a second recess formed on the outer sides thereof. The cover is joined with the heat sink to form a tube structure by respectively engaging the first and second connection portions with the first and second recesses. The light bar is disposed on a surface formed by a first end and a second end of the first and second supporting portions which are distant from the base.

15 Claims, 7 Drawing Sheets

LAMP TUBE

CROSS REFERENCE TO RELATED APPLICATIONS

The present application claims priority of Taiwan Patent Application No. 102139912, filed on Nov. 4, 2013, the entirety of which is incorporated by reference herein.

BACKGROUND OF THE INVENTION

1. Field of the Invention

The present application relates to a lamp tube, and in particular to a light-emitting diode (LED) lamp tube.

2. Description of the Related Art

Currently, there are two types of light-emitting diode (LED) lamp tubes in common use: all-plastic tubes and aluminum-plastic tubes. The structural strength and the thermal performance of the aluminum-plastic tubes are better than the all-plastic tubes.

FIG. 1 is a sectional view of a conventional aluminum-plastic lamp tube 10. The lamp tube 10 includes a cover 10*a* made of plastic, a heat sink 10*b* made of aluminum, and a light bar including a substrate 10*c*, at least a light-emitting element 10*d*, such as an LED, and several conductive wires 10*e*. The substrate 10*c* of the light bar can be fastened on the heat sink 10*b* by thermal grease G, such that the heat from the light bar can be dissipated through the heat sink 10*b*.

However, it should be noted that the traditional aluminum-plastic lamp tube 10 must comply with electrical safety standards. For example, a creepage distance D between the conductive wires 10*e* on the light bar and the heat sink 10*b* has to exceed a specific value. Thus, the dimensions of the substrate 10*c* may not be reduced owing to the limitation of the creepage distance D, so as to increase the production cost of the lamp tube 10. Furthermore, as shown in FIG. 1, the thickness D' of the heat sink 10*b* is about half of the entire thickness of the lamp tube 10. As such, it may also cause insufficient light-mixing distance of the lamp tube 10 (i.e. the distance between the light-emitting element 10*d* and the cover 10*a*), such that more LEDs are required to improve the illumination thereof. Consequently, the price-competitiveness of the product is adversely affected. For the reasons described above, an aluminum-plastic lamp tube which can comply with electrical safety standards, low cost requirements, and provide great illumination is needed.

BRIEF SUMMARY OF THE INVENTION

An embodiment of the invention provides a lamp tube, comprising a cover, a heat sink, and a light bar. The cover includes a first connection portion and a second connection portion opposite to each other. The heat sink includes a base, a first supporting portion, and a second supporting portion extended upwardly from the base. The first and second supporting portions respectively include a first recess and a second recess formed on the outer sides thereof. The cover is joined with the heat sink to form a tube structure by respectively engaging the first and second connection portions with the first and second recesses. The light bar is disposed on a surface formed by a first end and a second end of the first and second supporting portions which are distant from the base.

In another embodiment, the heat sink further includes a first fin and a second fin formed on two sides of the base.

In another embodiment, the first and second supporting portions respectively include a first wing structure and a second wing structure formed on the outer sides thereof, wherein the first recess is formed between the first wing structure and the first fin, and the second recess is formed between the second wing structure and the second fin.

In another embodiment, each of the first and second wing structures includes an inclined surface.

In another embodiment, each of the first and second recesses forms a concave structure.

In another embodiment, the first and second connection portions respectively include a first hook and a second hook engaged with the first and second recesses.

In another embodiment, the base forms a curved bottom surface.

In another embodiment, the first and second supporting portions form a slot therebetween.

In another embodiment, the light bar includes a substrate and a plurality of light-emitting elements on the substrate.

In another embodiment, a hole is formed on the substrate and aligned with the slot.

In another embodiment, the lamp tube further comprises a locking member penetrating through the hole and the slot, and the substrate is fixed to the surface formed by the first and second ends.

In another embodiment, the locking member comprises screw, rivet, or tenon.

In another embodiment, the first and second supporting portions and the base have a first distance therebetween, the cover and the base have a second distance therebetween, and the first distance is less than one-fourth of the second distance.

In another embodiment, the light-emitting elements are light-emitting diodes.

In another embodiment, the lamp tube further comprises a first end cap and a second end cap disposed on opposite ends of the tube structure.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
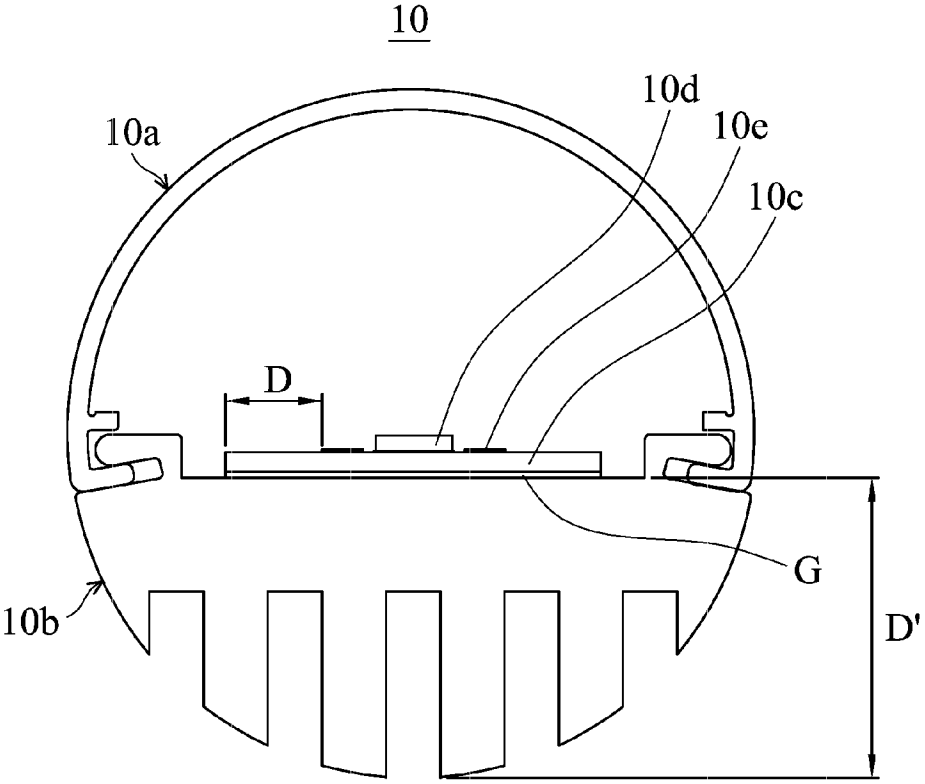
FIG. 1 ( PRIOR ART )
FIG. 1 is a sectional view of a conventional aluminum-plastic lamp tube.
Figure 2A:
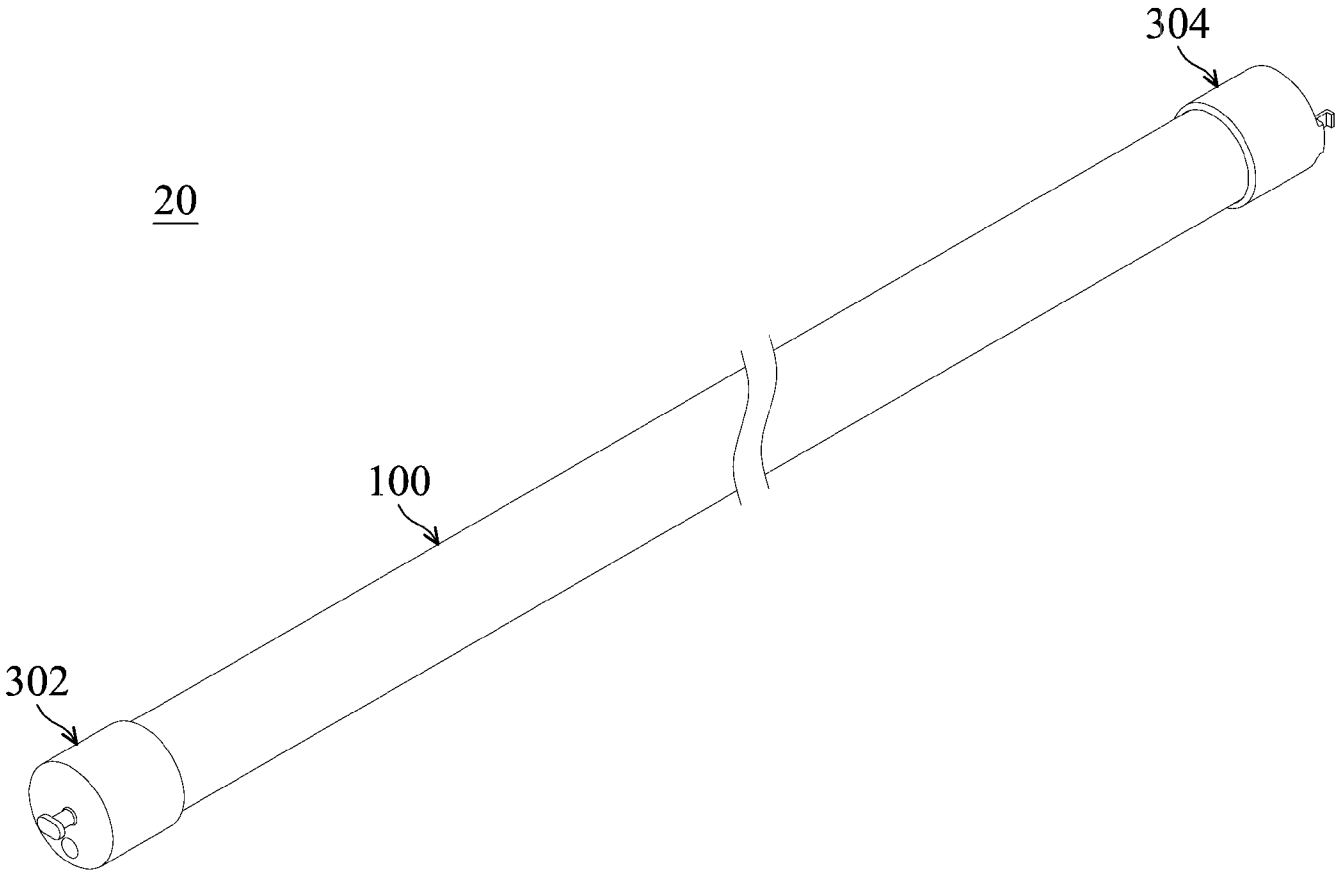
FIG. 2A is a perspective view of a lamp tube according to an embodiment of the invention.
Figure 2B:
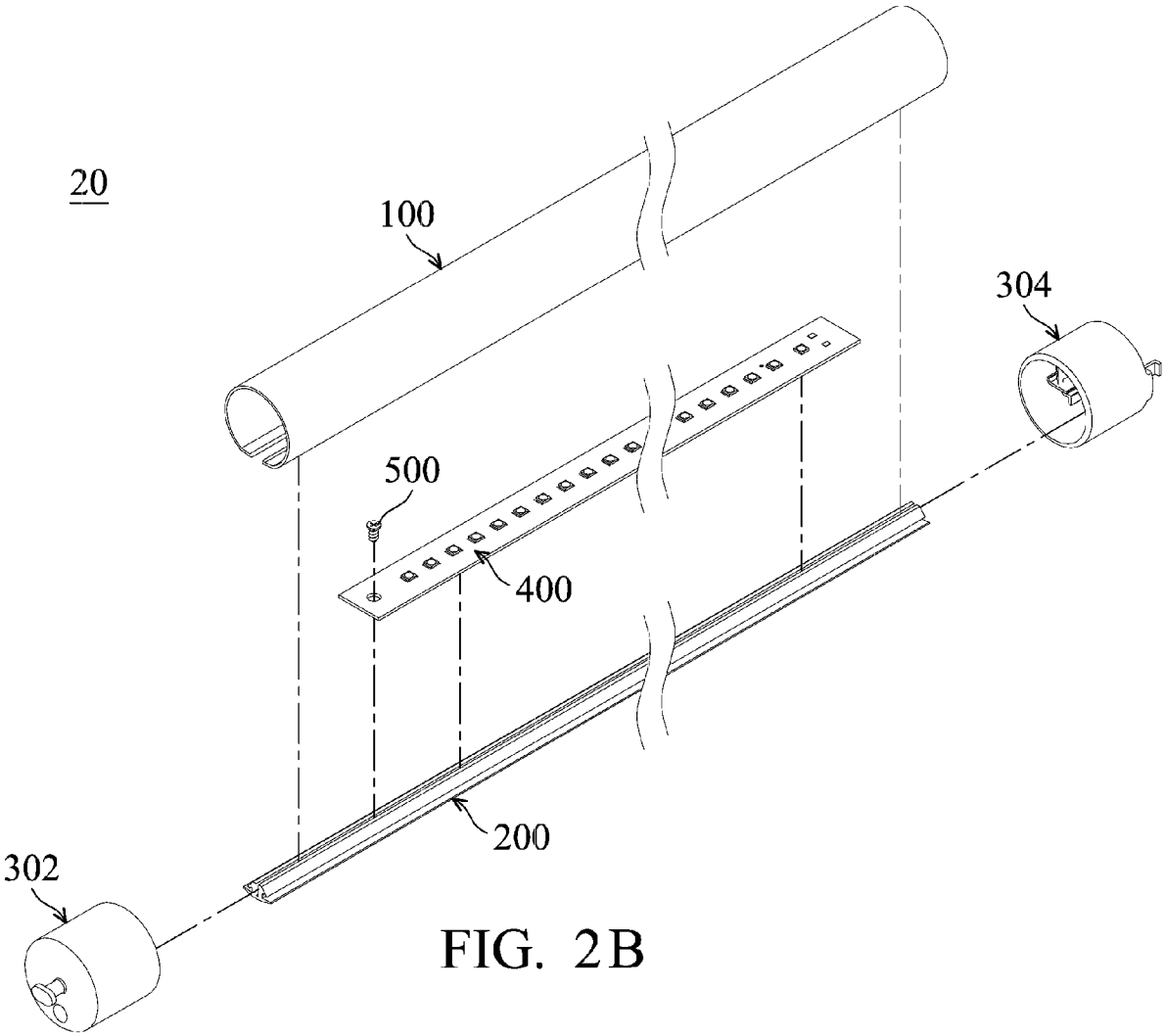
FIG. 2B is an exploded view of the lamp tube in FIG. 2A.

FIG. 2A and FIG. 2B are a perspective view and an exploded view of a lamp tube 20 according to an embodiment of the invention, respectively. The lamp tube 20 includes a cover 100, a heat sink 200, a first end cap 302, a second end cap 304, a light bar 400, and a locking member 500.

In this embodiment, the cover 100 is made of plastic, and the heat sink is made of aluminum. The cover 100 is joined with the heat sink 200 to form an aluminum-plastic tube structure. The light bar 400 is disposed in the tube structure and fixed to the heat sink 200 by the locking member 500, such as a screw (FIG. 2B), rivet, or tenon. The locking member 500 is non-conductive in this embodiment. In addition, the first and second end caps 302 and 304 are disposed on opposite ends of the tube structure, for receiving the drivers which provides electric power to the multiple light-emitting elements on the light bar 400. In some embodiments, the drivers may also be disposed outside the lamp tube 20 and electrically connected to the light-emitting elements on the light bar 400 through conductive wires.

The detailed description of the features of each member of the lamp tube 20 and the assembly method thereof is as follows.

Figure 2C:
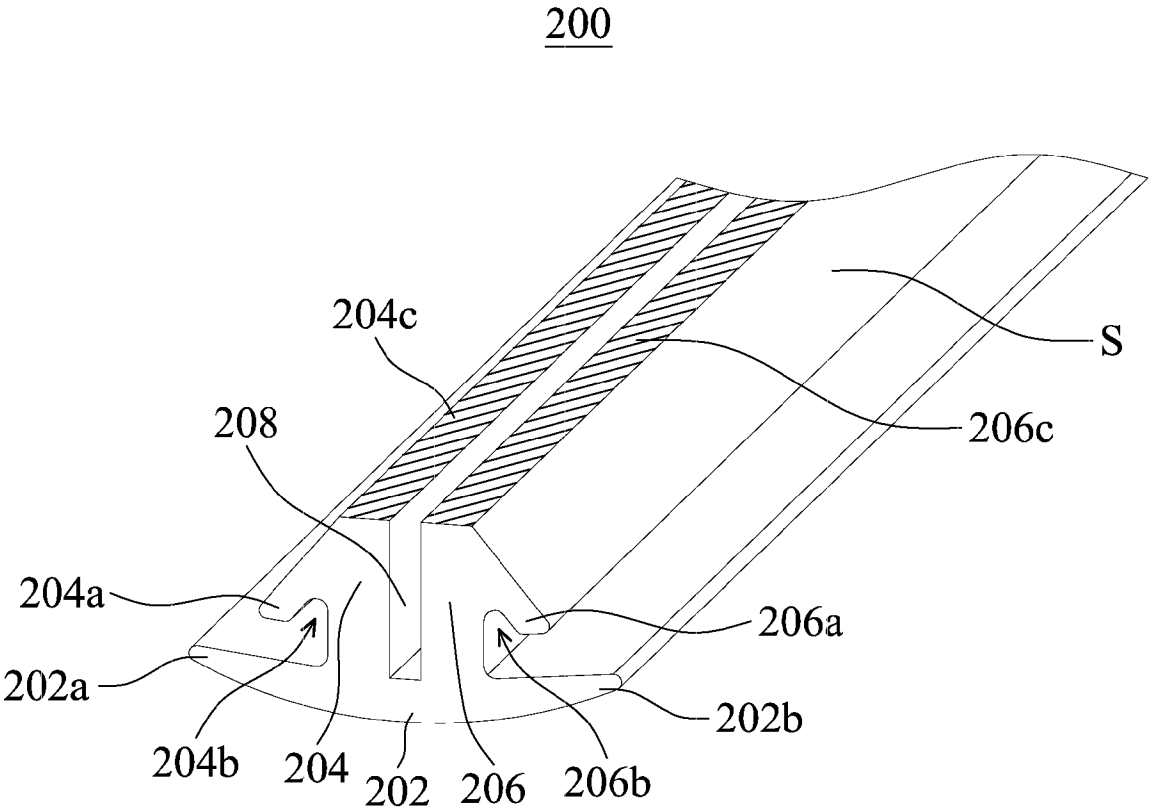
FIG. 2C is a partial enlarged view of the heat sink in FIG. 2B.

FIG. 2C is a partial enlarged view of the heat sink 200 in FIG. 2B. The heat sink 200 includes a base 202, a first supporting portion 204, and a second supporting portion 206 extended upwardly from the base 202. Moreover, the first and second supporting portions 204 and 206 form a slot 208 therebetween.

In this embodiment, the base 202 forms a curved bottom surface, and a first fin 202*a* and a second fin 202*b* are formed on opposite sides of the base 202. The first and second supporting portions 204 and 206 respectively include a first wing structure 204*a* and a second wing structure 206*a* formed on the outer sides thereof and extended toward the base 202 to form two inclined surfaces S. Moreover, the first and second supporting portions 204 and 206 respectively include a first recess 204*b* and a second recess 206*b* formed on the outer sides thereof, wherein each of the first and second recesses 204*b* and 206*b* forms a concave structure (FIG. 2C). The first recess 204*b* is formed between the first wing structure 204*a* and first fin 202*a*, and the second recess 206*b* is formed between the second wing structure 206*a* and the second fin 202*b*. Still referring to FIG. 2C, the first and second supporting portions 204 and 206 further include a first end 204*c* and a second end 206*c* which are distant from the base 202. It is noted that the first and second supporting portions 204 and 206 have the same height, and the first and second ends 204*c* and 206*c* form a surface (as the slash-marked portion shows in FIG. 2C) for supporting the light bar 400.

Figure 2D:
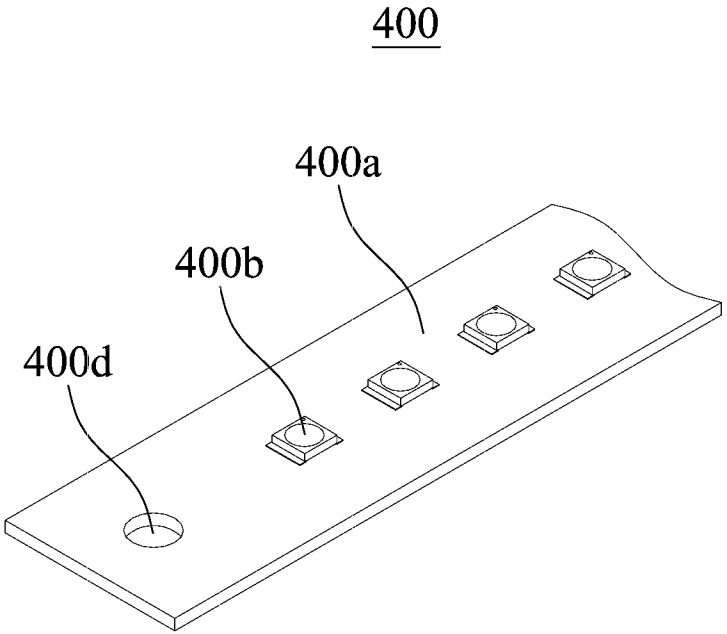
FIG. 2D is a partial enlarged view of the light bar in FIG. 2B.

FIG. 2D is a partial enlarged view of the light bar 400 in FIG. 2B. The light bar 400 includes a longitudinal substrate 400*a* with several light-emitting elements 400*b* and conductive wires (not shown) which connect to the light-emitting elements 400*b* disposed thereon. In this embodiment, the substrate 400*a* is a circuit board, and the light-emitting elements 400*b* are light-emitting diodes (LEDs) arranged along the longitudinal axis of the substrate 400*a*. Moreover, the light bar 400 further includes at least a hole 400*d* aligned with the slot 208 of the heat sink 200 when the light bar 400 is fixed to the heat sink 200 (see FIGS. 3A and 3B described below).

Figure 3A:
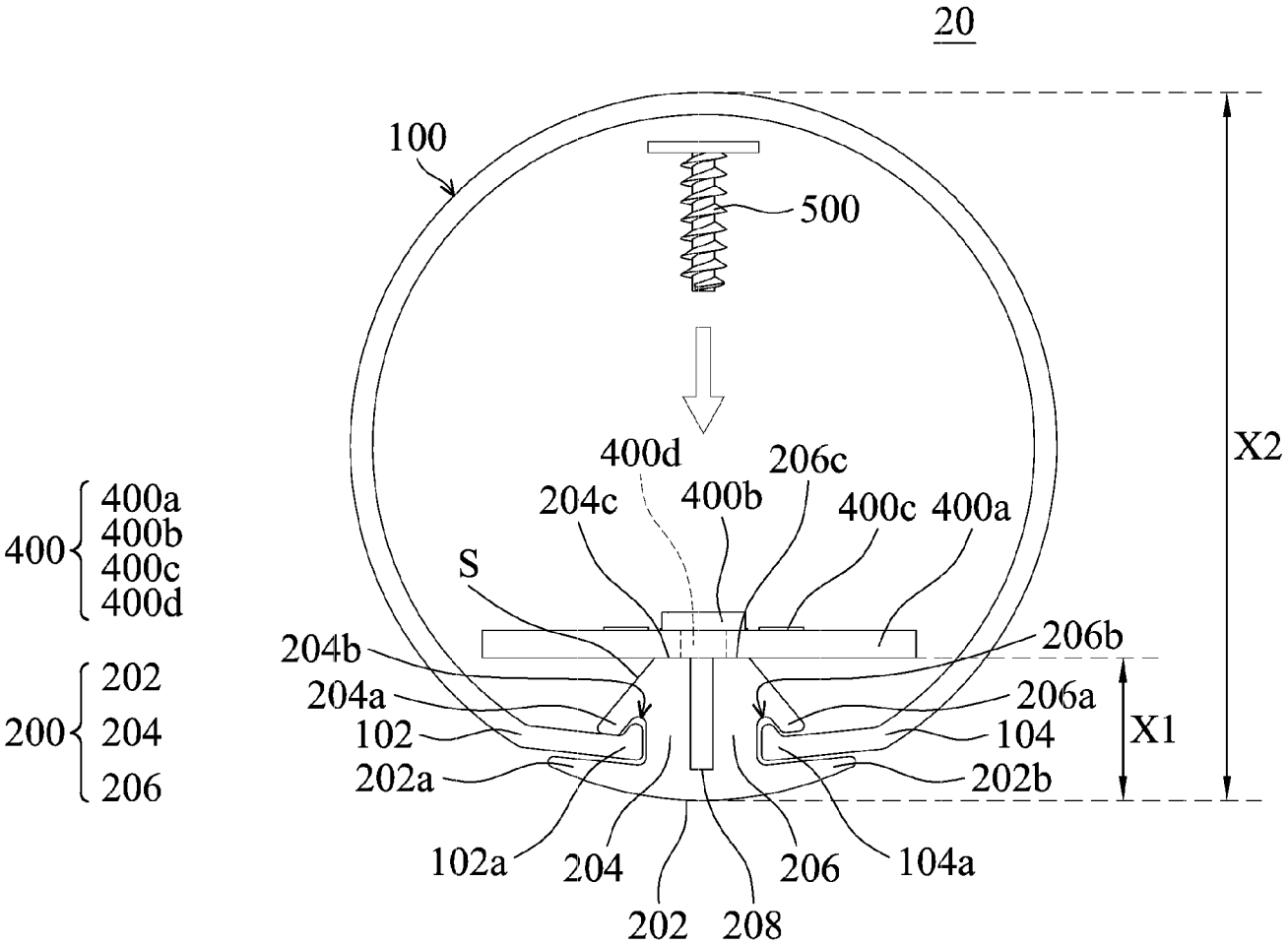
FIGS. 3A and 3B are sectional views showing the assembly method of the lamp tube in FIG. 2B.
Figure 3B:
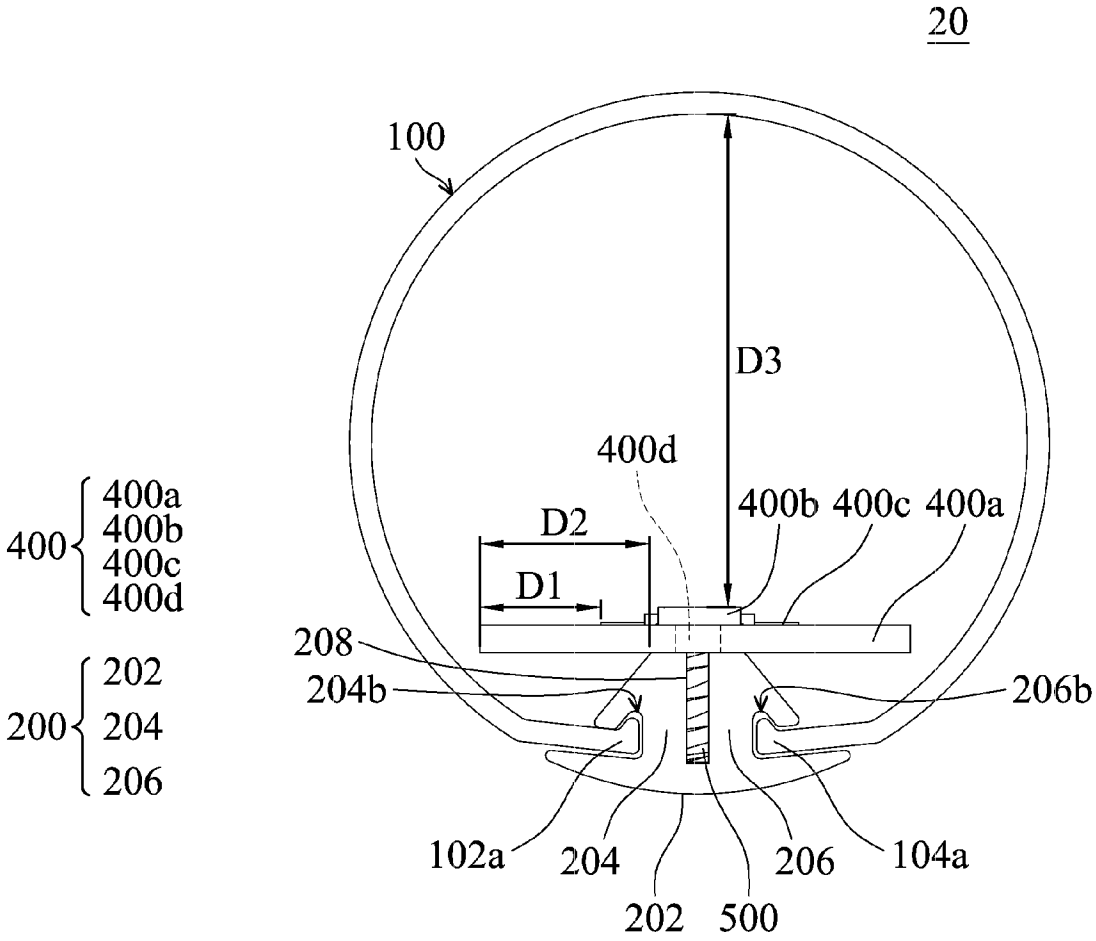

FIGS. 3A and 3B are sectional views showing the assembly method of the lamp tube 20 in FIG. 2B. As shown in FIGS. 3A and 3B, the cover 100 of this embodiment has a substantially circular cross-section and includes a first connection portion 102 and a second connection portion 104 opposite to each other. Specifically, the first and second connection portions 102 and 104 respectively include a first hook 102*a* and a second hook 104*a* for engaging with the first and second recesses 204*b* and 206*b* of the heat sink 200, such that the cover 100 can be securely joined with the heat sink 200 to form a tube structure.

The light bar 400 is disposed in the tube structure and disposed on the surface (FIG. 2C) formed by the first and second ends 204*c* and 206*c* of the first and second supporting portions 204 and 206 apart away from the base 202 of the heat sink 200. Furthermore, with the locking member 500 penetrating through the hole 400*d* on the substrate 400*a* and the slot 208 of the heat sink 200, the light bar 400 can be fastened on the heat sink 200 for rapid heat dissipation.

It should be emphasized that the heat sink 200 in this embodiment only contacts a central portion from the bottom of the substrate 400*a*, wherein the hole 400*d* can be formed and aligned with the central portion of the substrate 400*a*. Thus, the creepage distance between the conductive wires 400*c* on the substrate 400*a* and the heat sink 200 substantially equals the sum of the distance D1 between the conductive wires 400*c* and the edge of the substrate 400*a* and the distance D2 between the edge of the substrate 400*a* and the first end 204*c* (or the second end 206*c*), as shown in FIG. 3B. Accordingly, the aluminum-plastic lamp tube can comply with electrical safety standards (creepage distance), and the dimensions of the substrate 400*a* can be further reduced, lowering the production cost.

Still referring to FIGS. 3A-3B, in this embodiment, the first and second supporting portions 204 and 206 and the base 202 of the heat sink 200 have a first distance X1 therebetween, and the cover 100 and the base 202 have a second distance X2 therebetween. The first distance X1 can be less than one-fourth of the second distance X2, such that the occupied space of the heat sink 200 in the lamp tube 20 is reduced. Furthermore, a light-mixing distance D3 between the light-emitting elements 400*b* of the light bar 400 and the cover 100 can also be increased, thus improving the illumination of the lamp tube 20 without adding to the number of light-emitting elements 400*b*.

As described above, the invention provides an aluminum-plastic lamp tube. Specifically, the cover of the lamp tube includes hook structures securely joined with the heat sink. The heat sink is disposed close to the bottom of the lamp tube, and the thickness thereof does not exceed one-fourth of the entire thickness of the lamp tube. Therefore, the light-mixing distance between the light-emitting elements and the cover can be increased, thus improving the illumination of the lamp tube. Additionally, the light bar is fixed to a pair of the upwardly extended supporting portions of the heat sink through the locking member. Accordingly, the aluminum-plastic lamp tube can comply with electrical safety standards (creepage distance) and further reduce the dimensions of the light bar for reducing production cost.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lamp tube, comprising:

a cover, including a first connection portion and a second connection portion opposite to each other;

a heat sink, including a base, a first supporting portion, and a second supporting portion extended upwardly from the base, wherein the first and second supporting portions respectively include a first recess and a second recess formed on the outer sides thereof, and the cover is joined with the heat sink to form a tube structure by respectively engaging the first and second connection portions with the first and second recesses; and a light bar, disposed on a surface formed by a first end and a second end of the first and second supporting portions which are distant from the base.

2. The lamp tube as claimed in claim 1, wherein the heat sink further includes a first fin and a second fin formed on two sides of the base.

3. The lamp tube as claimed in claim 2, wherein the first and second supporting portions respectively include a first wing structure and a second wing structure formed on the outer sides thereof, wherein the first recess is formed between the first wing structure and the first fin, and the second recess is formed between the second wing structure and the second fin.

4. The lamp tube as claimed in claim 3, wherein each of the first and second wing structures includes an inclined surface.

5. The lamp tube as claimed in claim 3, wherein each of the first and second recesses forms a concave structure.

6. The lamp tube as claimed in claim 3, wherein the first and second connection portions respectively include a first hook and a second hook engaged with the first and second recesses.

7. The lamp tube as claimed in claim 1, wherein the base forms a curved bottom surface.

8. The lamp tube as claimed in claim 1, wherein the first and second supporting portions form a slot therebetween.

9. The lamp tube as claimed in claim 8, wherein the light bar includes a substrate and a plurality of light-emitting elements on the substrate.

10. The lamp tube as claimed in claim 9, wherein a hole is formed on the substrate and aligned with the slot.

11. The lamp tube as claimed in claim 10, further comprising a locking member penetrating through the hole and the slot, and the substrate is fixed to the surface formed by the first and second ends.

12. The lamp tube as claimed in claim 11, wherein the locking member comprises screw, rivet, or tenon.

13. The lamp tube as claimed in claim 9, wherein the light-emitting elements are light-emitting diodes.

14. The lamp tube as claimed in claim 1, wherein the first and second supporting portions and the base have a first distance therebetween, the cover and the base have a second distance therebetween, and the first distance is less than one-fourth of the second distance.

15. The lamp tube as claimed in claim 1, further comprising a first end cap and a second end cap disposed on opposite ends of the tube structure.

* * * * *